US007687414B2

(12) United States Patent
Hagi

(10) Patent No.: US 7,687,414 B2
(45) Date of Patent: Mar. 30, 2010

(54) FLAMEPROOF UNION FABRIC FOR CHAIR UPHOLSTERY

(75) Inventor: Hiroyasu Hagi, Akashi (JP)

(73) Assignee: Kaneka Corporation, Osaka (JP)

( * ) Notice: Subject to any disclaimer, the term of this patent is extended or adjusted under 35 U.S.C. 154(b) by 31 days.

(21) Appl. No.: 12/225,752

(22) PCT Filed: Apr. 5, 2007

(86) PCT No.: PCT/JP2007/057659

§ 371 (c)(1),
(2), (4) Date: Sep. 29, 2008

(87) PCT Pub. No.: WO2007/116938

PCT Pub. Date: Oct. 18, 2007

(65) Prior Publication Data

US 2010/0047513 A1 Feb. 25, 2010

(30) Foreign Application Priority Data

Apr. 6, 2006 (JP) ..... 2006-105728

(51) Int. Cl.
*D03D 15/00* (2006.01)

(52) U.S. Cl. ..... 442/301; 442/208; 442/209; 442/210; 442/211; 442/212; 442/213; 442/214; 442/215; 442/216

(58) Field of Classification Search ..... 442/208–216, 442/222, 301
See application file for complete search history.

(56) References Cited

FOREIGN PATENT DOCUMENTS

| | | |
|---|---|---|
| JP | 05-125633 | 5/1993 |
| JP | 10-072743 | 3/1998 |
| JP | 10-259542 | 9/1998 |
| JP | 11-001842 | 1/1999 |
| JP | 2003-166121 | 6/2003 |
| JP | 2003-201642 | 7/2003 |
| JP | 2005-179876 | 7/2005 |
| JP | 2005-522532 | 7/2005 |
| WO | WO 03/085039 A1 | 10/2003 |

*Primary Examiner*—Lynda Salvatore
(74) *Attorney, Agent, or Firm*—Hamre, Schumann, Mueller & Larson, P.C.

(57) ABSTRACT

A union fabric comprising 6 to 60% by weight of a polyester fiber (A), 35 to 85% by weight of a halogen-containing fiber (B), and 5 to 55% by weight of a cellulose fiber (C) in which fabric the warp comprises weaving yarn containing the polyester fiber and the weft comprises flameproof chenille yarn and other weaving yarn, with the chenille yarn containing 10 to 70% by weight of halogen and 1 to 35% by weight of a flame retardant consisting of a metal compound, and in which fabric the content of the warp-constituting weaving yarn containing the polyester fiber is 20 to 40% by weight and those of the weft-constituting flameproof chenille yarn and the weft-constituting other weaving yarn are 35 to 70% by weight and 10 to 45% by weight respectively. This union fabric is excellent in design, texture, comfortableness in use.

19 Claims, No Drawings

FLAMEPROOF UNION FABRIC FOR CHAIR UPHOLSTERY

TECHNICAL FIELD

The present invention relates to a union fabric having flame retardant properties, and more particularly to a flame retardant union fabric suitable for chair upholstery or the like.

BACKGROUND ART

In recent years, the demand for securing safety of food, clothing, and housing has increased. In accordance therewith, the necessity for a raw material having flame retardant properties has increased. Under the circumstances, the demand for a textile having not only designability but also flame retardant properties has increased in the field of interior materials, especially in the field of chair upholstery.

In order to give designability to a textile, there is a method of producing a napped cloth using a design yarn referred to as a chenille yarn. However, the chenille yarn is likely to keep on burning because the napped part is in contact with a large amount of air. Thus, a cloth produced using the chenille yarn has a problem that the cloth is highly flammable.

Moreover, a method of giving flame retardant properties has conventionally been proposed which involves applying resin containing a flame retardant to the rear surface of a flammable cloth (e.g., Patent Document 1). However, when the flame retardant is adhered to the cloth as described above, there are problems that the cloth is whitened or the cloth becomes sticky under the effect of the flame retardant. Furthermore, in such a cloth, the cloth is sometimes discolored, stiffened, or reduced in volume in a napped part by the processing heat. Moreover, such a cloth has disadvantages that the frame retardant performance of the cloth decreases with time due to exposure to daylight, moisture absorption, etc., or, when the cloth is washed with water or dry-cleaned, the flame retardant is removed, resulting in loss of the frame retardant effect. In particular, a chair in which a flammable urethane foam is used as an internal padding and the padding is covered with a cloth to which a flame retardant has been adhered requires a lot of flame retardants for securing flame retardant properties. Thus, such a chair is limited in the designability and the comfortableness and moreover has a disadvantage in the cost. Thus, the cloth to which the flame retardant has been adhered has not been satisfactory in terms of the designability or flame retardant properties.

Moreover, a flame retardant polyester fiber and a fabric using the flame retardant polyester fiber have been proposed (e.g., Patent Documents 2 and 3). However, the cloth using the flame retardant polyester fiber is easy to make a big hole at the time of combustion due to melting of polyester fiber. Therefore, in the case of a chair in which an internal urethane foam is covered with the cloth, the urethane foam is ignited, and thus the flame retardant properties is not sufficiently secured.

In addition, a cloth using a flame retardant acrylic fiber has been proposed (e.g., Patent Documents 4, 5, and 6). However, also in the case of a cloth using the flame retardant acrylic fiber, a fabric in which a weaving yarn using a polyester fiber which is most advantageous in cost, designability, and productivity and widely used is used for a warp sometimes opens a hole due to the melting of polyester fiber and shrinkage or thermal decomposition of the flame retardant acrylic fiber at the time of combustion, and there is room for improvement. Moreover, in the case of the cloth using the flame retardant acrylic fiber, a polyester fiber has been required to be used as a composite fiber, such as a union yarn. Therefore, the flame retardant acrylic fiber was not able to widely use as chair upholstery.

Further, as a material which blocks combustion, a crosslinked highly flame-retardant acrylic fiber in which a thermally crosslinked polymer and an antimony oxide are added to the flame retardant acrylic fiber has also been proposed (e.g., Patent Document 7). The crosslinked highly flame-retardant acrylic fiber appears to demonstrate an effect in a state where the fabric is slackened. However, in the case where the crosslinked highly flame-retardant acrylic fiber is used for covering an urethane foam or the like similarly when used as, for example, chair upholstery, and then combusted, tension is applied to the fiber, resulting in that the fiber is likely to make a hole due to the shrinkage of the fiber similarly as another acrylic fiber and the urethane foam is ignited. Therefore, the flame retardant properties have not been sufficiently secured only by the use of the crosslinked highly flame-retardant acrylic fiber.

Patent-Document 1: Japanese Unexamined Patent Application Publication (Translation of PCT application) No. 2005-522532

Patent-Document 2: Japanese Unexamined Patent Application Publication No. 2003-166121

Patent Document 3: Japanese Unexamined Patent Application Publication No. 10-72743

Patent-Document 4: Japanese Unexamined Patent Application Publication No. 10-259542

Patent-Document 5: Japanese Unexamined Patent Application Publication No. 11-1842

Patent-Document 6: Japanese Unexamined Patent Application Publication No. 2003-201642

Patent-Document 7: Japanese Unexamined Patent Application Publication No. 2005-179876

DISCLOSURE OF THE INVENTION

Technical Problems to be Solved

In order to solve the problems in view of the above-described circumstances, the present invention is to provide, at low cost, a union fabric which is excellent in designability and texture, whose abrasion resistance is improved, and which is comfortable and has high flame retardant properties.

Means to Solve the Problems

In order to solve the above-described problems, the present inventors conducted extensive research. As a result, the present inventors found that a union fabric having high flame retardant properties can be obtained by the combined use of a chenille yarn containing halogen and a metal compound flame retardant at a given ratio and a cellulose fiber in the union fabric, even when a polyester fiber is contained. Thus, the present invention has been accomplished.

More specifically, the flame retardant union fabric of the present invention is a flame retardant union fabric made of a warp and a weft and containing a polyester fiber (A), a halogen fiber (B), and a cellulose fiber (C). In the flame retardant union fabric of the present invention, the warp contains a weaving yarn containing polyester fiber and the weft contains a flame retardant chenille yarn and another weaving yarn, and the flame retardant chenille yarn contains 10 to 70% by weight of halogen and 1 to 35% by weight of metal compound flame retardant. Moreover, according to a preferable aspect, the union fabric contains 6 to 60% by weight of the polyester fiber (A), 35 to 85% by weight of the halogen fiber (B), and 5 to 55% by weight of the cellulose fiber (C). Furthermore, according to another preferable aspect, the union fabric contains 20 to 40% by weight of the weaving yarn containing polyester fiber forming the warp, and 35 to 70% by weight of the flame retardant chenille yarn and 10 to 45% by weight of the another weaving yarn forming the weft.

The "fiber" as used in the specification refers to a monofilament. For example, a long fiber (filament), a short fiber (staple), etc., are mentioned. Moreover, the "yarn" as used in the specification refers to a long and narrow linear fiber bundle which is obtained by gathering the fiber. For example, a spun yarn obtained by arranging the short fiber in equilibrium, joining the fibers together, and twisting the joined fibers and a paralleled yarn obtained by paralleling the long fiber are mentioned. Furthermore, the "fabric" as used in the specification refers to a fiber composites textile woven by a loom using a weaving yarn, such as a spun yarn. The "union fabric" as used in the specification is refers to a fabric obtained by weaving a warp and a weft in combination in which the warp and the weft are generally crossed alternately at right angles.

Further, the "chenille yarn" as used in the specification is a kind of a fancy twisted yarn having a fluff-like napped part throughout the yarn, and refers to a yarn obtained by interlacing another yarn between a plurality of yarns, serving as a base, using a special machine while cutting the another yarn into a length of several millimeters, twisting the plurality of yarns, serving as the base, and raising the yarn that has been cut into a length of several millimeters. Moreover, the "fancy yarn" as used in the specification refers to a yarn that is cut to form a napped part of the chenille yarn. Moreover, a "wadding" as used in the specification refers to a yarn used for parts other than the fancy yarn, and refers to a yarn which is twisted and serves as a base of the chenille yarn. There is no limitation on methods of forming the chenille yarn using the above-mentioned fancy yarn and wadding, but it is preferable to use an apparatus described in Japanese Unexamined Patent Application Publication No. 53-6642 and the like, for example.

Moreover, it is preferable that the another weaving yarn forming the weft with the flame retardant chenille yarn contain the cellulose fiber (C).

Furthermore, it is preferable that the fabric weight of the union fabric be 300 to 600 g/m$^2$.

Moreover, it is preferable that the thickness of the fancy yarn serving as the napped part of the flame retardant chenille yarn be a yarn of 30 to 68 metric count.

The "metric count" as used in the specification refers to a number indicating the length of a yarn per kg by mass in a unit of km. For example, a yarn of 40 metric count refers to a yarn of 40 km/kg.

Moreover, it is preferable that the wadding of the flame retardant chenille yarn be twisted at 700 to 900 times/m.

Furthermore, it is preferable that the wadding of the flame retardant chenille yarn be twisted, and further twisted in the same direction as the previous twist direction.

Moreover, it is preferable that the flame retardant chenille yarn be a yarn in which the wadding has two two-ply yarns, and the wadding is further twisted in the same directions with the twist directions of the respective two two-ply yarns.

Moreover, it is preferable that the flame retardant chenille yarn contain 2.5 to 15% by weight of a nylon fiber in the wadding.

Moreover, it is preferable that the flame retardant chenille yarn contain 42.5 to 100% by weight of the halogen fiber (B) in the wadding.

Furthermore, it is preferable that the halogen fiber (B) in the flame retardant chenille yarn contain 0.1 to 50% by weight of the metal compound flame retardant.

It is preferable that the halogen-containing fiber (B) in the flame retardant chenille yarn be a fiber containing a copolymer containing 30 to 70% by weight of acrylonitrile, 70 to 30% by weight of halogen-containing vinyl polymer, and 0 to 10% by weight of vinyl monomer that is polymerizable with the acrylonitrile and the halogen-containing vinyl polymer in such a manner that the total content becomes 100% by weight.

Furthermore, it is preferable that the halogen-containing vinyl polymer be a vinylidene chloride polymer.

Moreover, it is preferable that the halogen-containing fiber (B) in the flame retardant chenille yarn have a decomposition starting temperature of 200 to 260° C.

The above-mentioned "decomposition starting temperature" refers to a decomposition starting temperature according to JIS-K7120.

Moreover, it is preferable that the halogen-containing fiber (B) in the flame retardant chenille yarn have a melting temperature of 170 to 240° C.

When tension is applied to a fiber under a fixed load, and then the fiber is heated, the fiber shrinks, and then extends due to melting or decomposition. The "melting temperature" refers to a temperature at which the extension starts.

It is preferable that the flame retardant chenille yarn is a yarn containing 42.5 to 100% by weight of the cellulose fiber (C) in the wadding and containing the halogen-containing fiber (B) also in the fancy yarn serving as a napped part.

It is preferable that the metal compound flame retardant is at least one selected from the group consisting of Sb compounds, Sn compounds, Zn compounds, Mg compounds, and composite compounds containing at least two metal elements selected from Sb, Sn, Zn, and Mg.

It is preferable that the metal compound flame retardant be at least one selected from the group consisting of Sb compounds, Sn compounds, Zn compounds, and composite compounds containing metal elements of Sn and Zn.

EFFECT OF THE INVENTION

The flame retardant union fabric of the present invention described above uses the flame retardant chenille yarn as a yarn forming the weft and contains a polyester fiber in the warp. Thus, the flame retardant union fabric of the present invention has excellent designability and favorable texture, is comfortable, and has a sufficient abrasion resistance and high flame retardant properties. In particular, when the flame retardant union fabric of the present invention is used as upholstery for a product such as a chair, using a flammable cushioning material such as urethane foam, for the internal padding, the internal padding can be prevented from flaming even when the product is exposed to fire. This is because the flame retardant union fabric has self-extinguishing properties and forms a carbonized film.

BEST MODE FOR CARRYING OUT THE INVENTION

As described above, the flame retardant union fabric of the present invention is a flame retardant union fabric made of a warp and a weft, and contains a polyester fiber (A), a halogen fiber (B), and a cellulose fiber (C). In the flame retardant union fabric of the present invention, the warp contains a weaving yarn containing polyester fiber and the weft contains a flame retardant chenille yarn and another weaving yarn; and the flame retardant chenille yarn contains 10 to 70% by weight of halogen and 1 to 35% by weight of metal compound flame retardant.

The polyester fiber (A) refers to a fiber in which a polymer forming a fiber formed of a long chain synthetic polymer containing an ester unit of terephthalic acid and dihydric alcohol in a proportion of 85% by weight or more based on a mass ratio. For example, a polyethylene terephthalate fiber, a polytrimethylene terphthalate fiber, and a polybutylene terephthalate fiber are mentioned. Moreover, a polyester fiber which has been rendered flame retardant by post processing using a flame retardant or a polyester fiber containing a flame retardant may be used. The above-mentioned polyester fiber may contain various kinds of additives, such as a delustering agent, a thermostabilizer, a defoaming agent, an orthochromatic agent, an antioxidant, a UV absorber, an infrared absorbing agent, a crystal nucleating agent, and a fluorescent brightening agent, as required. These additives may be used singly or in combination of two or more thereof. In the "flame retardant" of the present invention, halogen contained in a monomer forming a polymer in the halogen-containing fiber (B) mentioned later is not contained, but the polyester fiber (A) may be a halogen-containing fiber.

The halogen-containing fiber (B) refers to a fiber made of a polymer of a monomer containing halogen; a fiber made of a copolymer of the monomer containing halogen and a monomer not containing halogen; a fiber made of a polymer blend material of a polymer containing halogen and a polymer not containing halogen and a halogen-containing polymer to which halogen has been introduced by post processing; and a fiber obtained by blending halogen in a fiber made of a polymer not containing halogen by post processing. For example, as the halogen-containing fiber (B), homopolymers and copolymers of a halogen-containing monomer such as vinyl chloride and vinylidene chloride are mentioned. Mentioned as other halogen-containing fibers are copolymers of the above-mentioned halogen containing monomer and a monomer copolymerizable with the halogen containing monomer, such as acrylonitrile, styrene, vinyl acetate, and acrylic ester. Furthermore, as the halogen-containing fiber (B), a graft polymer in which the halogen-containing monomer is grafted to a PVA polymer and the like are mentioned, but the halogen-containing fiber (B) is not limited thereto. As a preferable example of the halogen-containing fiber (B), a modacrylic fiber which is a fiber formed of a copolymer of a halogen containing monomer and acrylonitrile is mentioned. The halogen-containing fiber (B) may be a halogen-containing polyester fiber. Moreover, the above-mentioned halogen-containing fiber (B) may contain, as required, various kinds of additives, such as a delustering agent, a thermostabilizer, a defoaming agent, an orthochromatic agent, a flame retardant, an antioxidant, a UV absorber, an infrared absorbing agent, and a fluorescent brightening agent. The additives may be used singly or in combination of two or more thereof.

Examples of the cellulose fiber (C) include cotton, hemp, rayon, polynosic, cuprammonium rayon, acetate, triacetate, etc. Moreover, a cellulose fiber which has been rendered flame retardant by post processing using a flame retardant and a silica-containing cellulose fiber containing silica or/and aluminum silicate as a flame retardant may be used. These fibers may be used singly or in combination of two or more thereof. Examples of the flame retardant for use in rendering a substance flame retardant by post processing include: phosphate compounds, such as triphenyl phosphate, tricresyl phosphate, trixylenyl phosphate, trimethyl phosphate, triethyl phosphate, cresyl phenyl phosphate, xylenyl diphenyl phosphate, resorcinol bis(diphenyl phosphate), 2-ethylhexyl diphenyl phosphate, dimethylmethyl phosphate, triallyl phosphate (REOFOS), aromatic phosphate, phosphonocarboxylic amide derivative, tetrakis hydroxymethyl phosphonium derivative, and N-methylol-dimethylphosphonopropionamide; halogen-containing phosphate compounds, such as tris(chloroethyl)phosphate, trisdichloropropyl phosphate, tris-β-chloropropyl phosphate, chloroalkyl phosphate, tris (tribromoneopentyl)phosphate, diethyl-N,N-bis(2-hydroxyethyl)aminomethyl phosphate, and tris(2,6-dimethylphenyl) phosphate; condensed phosphate compounds, such as aromatic condensed phosphate and halogen-containing condensed phosphate; polyphosphate compounds, such as polyphosphoric-acid ammonium amide and polychlorophosphonate; and polyphosphate compounds, such as polyphosphoric-acid carbamate. In addition thereto, phosphate-urea compounds, such as red phosphorus, an amine compound, boric acid, a halide compound, a bromide, a urea-formaldehyde compound, and a phosphorus-containing aminoplast; ammonium sulfate; a guanidine condensate; etc., are mentioned. These flame retardants may be used singly or in combination of two or more thereof. Moreover, the cellulose fiber may contain, as required, various kinds of additives, such as a delustering agent, a thermostabilizer, a defoaming agent, an orthochromatic agent, an antioxidant, a UV absorber, an infrared absorbing agent, and a fluorescent brightening agent.

Since the union fabric of the present invention contains 35 to 85% by weight of the halogen-containing fiber (B) and 5 to 55% by weight of the cellulose fiber (C), the union fabric of the present invention has an effect of preventing the formation of a hole at the time of combustion and can be improved in the flame retardant properties even when a large amount of the polyester fiber (A) is contained mainly in the warp as described later. More preferably, 40 to 65% by weight of the halogen-containing fiber (B) is blended in the union fabric. When the content of the halogen-containing fiber (B) in the fabric is lower than 35% by weight, flame retardant properties are insufficient, which makes it difficult to maintain flame retardant properties of a fabric which is a final product. When the content of the halogen-containing fiber (B) in the fabric exceeds 85% by weight, heat resistance of a fabric which is a final product is poor, causing deterioration in processability and reduction in flame retardant properties. Thus, the above-mentioned contents are not preferable. Moreover, the cellulose fiber (C) is blended in the union fabric in a proportion of preferably 10 to 40% by weight, and more preferably 15 to 35% by weight. When the content of the cellulose fiber (C) in the union fabric is lower than 5% by weight, an effect of preventing the formation of a hole at the time of combustion is low. When the content of the cellulose fiber (C) in the union fabric exceeds 55% by weight, a hole is not made, but combustion is likely to continue. In any cases, the flame retardant properties of a fabric which is a final product are insufficient. Thus, the above-mentioned contents are not preferable.

The polyester fiber (A) may be blended in the union fabric in a proportion of 6 to 85% by weight, preferably 6 to 60% by weight, more preferably 6 to 40% by weight, still more preferably 20 to 40% by weight, and particularly preferably 25 to 35% by weight. The polyester fiber (A) is blended in the union fabric in any forms without limitation, but the polyester fiber is blended at least in the warp. When the polyester fiber (A) also contains halogen, the total content of a polyester fiber also including the polyester fiber containing halogen is adjusted to be 6 to 85% by weight in a fabric.

Moreover, the halogen-containing fiber (B) is contained in the union fabric in a proportion of preferably 35 to 85% by weight, more preferably 40 to 65% by weight, and still more preferably 40 to 60% by weight. The halogen-containing fiber (B) is blended in the union fabric in any forms without limitation. It is preferable to use the halogen-containing fiber (B) as a fiber forming a flame retardant chenille yarn, mentioned later, which is used as the weft.

The cellulose fiber (C) is blended in the union fabric in a proportion of preferably 5 to 55% by weight, more preferably 10 to 40% by weight, and still more preferably 15 to 35% by weight. The cellulose fiber (C) is blended in the union fabric in any forms without limitation. The cellulose fiber (C) can be blended in a fabric by, for example, mixing the cellulose fiber in a flame retardant chenille yarn, mentioned later, which is used as the weft; twisting the flame retardant chenille yarn and a yarn made of the cellulose fiber, and using the resultant as the weft; mixing the cellulose fiber in a yarn to be used for the warp; twisting a yarn made of the cellulose fiber and other yarn, and using the resultant as the warp; and using, as the weft, a mixed yarn of the cellulose fiber, a twisted yarn of the cellulose fiber, or a yarn made of the cellulose fiber is used together with a flame retardant chenille yarn mentioned later. Among the various manners of containing the cellulose fiber, it is preferable to blend the cellulose fiber (C) in the "another weaving yarn" used, as the weft, with the flame retardant chenille yarn mentioned later.

The warp forming the union fabric of the present invention contains a weaving yarn containing the polyester fiber (A) (hereinafter referred to as a "weaving yarn containing polyester fiber"). The weaving yarn containing polyester fiber contains a polyester fiber in the form of a filament or a staple. The weaving yarn containing polyester fiber uses a weaving yarn, such as a regular yarn or a processed yarn formed of a polyester fiber; and a mixed yarn or a processed yarn of a polyester fiber and a natural fiber or a synthetic fiber, such as cotton or rayon. These yarns may be used singly or in combination of two or more thereof. By blending the polyester fiber (A) in the warp, the tensile strength can be increased even when the yarn is thin. Thus, since the tensile strength of a union fabric can be increased, such a yarn is preferable as a warp for a union fabric. From the view point of the yarn tensile strength as a warp for a fabric, the content of the polyester fiber (A) is preferably 30% by weight or more in the warp. Moreover, in terms of ease of availability, it is more preferable that the content of the polyester fiber (A) be 100% by weight in the warp, i.e., using a yarn formed only of the polyester fiber (A) as the warp. Moreover, the weaving yarn containing polyester fiber forming the warp is blended in a union fabric in a proportion of preferably 20 to 40% by weight, and more preferably 25 to 35% by weight.

Moreover, the weft forming the union fabric of the present invention contains a flame retardant chenille yarn and another weaving yarn. The proportion of the fancy yarn and the wadding in the flame retardant chenille yarn may be suitably determined in accordance with properties demanded for a union fabric which is a final product, and the proportion thereof is not limited. In order to impart favorable designability and required strength to the flame retardant chenille yarn, the content of the wadding in the chenille yarn is preferably 10 to 40% by weight, and more preferably 20 to 35% by weight. It is preferable to blend the cellulose fiber (C) to the "another weaving yarn" used with the flame retardant chenille yarn. It is more preferable that the "another weaving yarn" contain 100% of cellulose fiber (C), i.e., using a yarn containing only the cellulose fiber (C) for the weft as the "another weaving yarn". It is preferable that the flame retardant chenille yarn and the another weaving yarn be alternately used as the weft. The weft is exposed to the front surface and the rear surface of a textile. By adjusting the exposure amount, various woven patterns can be given to the front surface of the textile.

The flame retardant chenille yarn in the present invention refers to a chenille yarn having self-extinguishing properties and incombustible properties. By using such a flame retardant chenille yarn for the weft of the union fabric, flame retardant properties, such as self-extinguishing properties, are imparted to the fabric. The flame retardant chenille yarn contains 10 to 70% by weight of halogen and 1 to 35% by weight of a metal compound flame retardant. The halogen can be blended in the chenille yarn by blending a halogen-containing flame retardant in the chenille yarn by post processing or the like or using wadding or a fancy yarn containing a halogen-containing fiber at the time of forming the chenille yarn. Using a yarn containing the halogen-containing fiber (B) for wadding or a fancy yarn is simple, and thus is preferable. The halogen content in the flame retardant chenille yarn is preferably 22 to 45% by weight. When the halogen content in the chenille yarn is lower than 10% by weight, flame retardant properties of the chenille yarn are insufficient, which makes it difficult to maintain flame retardant properties of a fabric which is a final product. When the halogen content in the chenille yarn exceeds 70% by weight, heat resistance of the chenille yarn decreases, which causes deterioration in processability and reduction in flame retardant properties of a fabric which is a final product. Thus, the above-mentioned contents are not preferable. The metal compound flame retardant can be blended by blending the metal compound flame retardant in the chenille yarn by post processing or the like or using wadding and a fancy yarn containing a fiber containing the metal compound flame retardant at the time of forming the chenille yarn. Using a yarn containing the metal compound flame retardant for wadding or a fancy yarn is simple, and thus is preferable. The metal compound flame retardant is blended in the flame retardant chenille yarn in a proportion of preferably 1 to 10% by weight, and more preferably 2 to 6% by weight. When the content of the metal compound flame retardant in the chenille yarn is lower than 1% by weight, flame retardant properties of the chenille yarn are insufficient, which makes it difficult to maintain flame retardant properties of a fabric which is a final product. When the content of the metal compound flame retardant in the chenille yarn exceeds 35% by weight, physical properties, such as strength, processability, and glossy feeling of the chenille yarn decrease and the quality of a fabric deteriorates. Thus, the above-mentioned contents are not preferable. The flame retardant chenille yarn is contained in a union fabric in a proportion of preferably 35 to 70% by weight, more preferably 40 to 60% by weight, and still more preferably 45 to 60% by weight. In contrast, the "another yarn" used with the flame retardant chenille yarn is blended in a union fabric in a proportion of 10 to 65% by weight. The proportion thereof is preferably 10 to 45% by weight, more preferably 10 to 40% by weight, and still more preferably 15 to 35% by weight. Therefore, it is preferable that the flame retardant union fabric of the present invention contain 20 to 40% by weight of the polyester fiber-containing weaving yarn forming a warp, 35 to 70% by weight of the flame retardant chenille yarn forming a weft, and 10 to 45% by weight of the another weaving yarn. It is more preferable that the flame retardant union fabric of the present invention contain 25 to 35% by weight of the polyester fiber-containing weaving yarn, 40 to 60% by weight of the flame retardant chenille yarn, and 10 to 40% by weight of the another weaving yarn. It is still more preferable that the flame retardant union fabric of the present invention contain 25 to 35% by weight of the polyester fiber-containing weaving yarn, 45 to 60% by weight of the flame retardant chenille yarn, and 15 to 35% by weight of the another weaving yarn.

Specific examples of the metal compound flame retardant include Sb compounds, such as antimony trioxide, antimony pentoxide, antimonic acid, and antimony oxychloride; Sn compounds, such as stannic oxide, metastannic acid, stannous oxyhalide, stannic oxyhalide, stannous hydroxide, and tin tetrachloride; Zn compounds, such as zinc oxide; Mg compounds, such as magnesium oxide and magnesium hydroxide; Mo compounds, such as molybdenum oxide; Ti compounds, such as titanium oxide and barium titanate; P compounds, such as polyphosphoric acid ammonium and dibutylamino phosphate; Al compounds, such as aluminium hydroxide, aluminium sulfate, and aluminum silicate; Zr compounds, such as zirconium oxide; Si compounds, such as silicate and glass; natural or synthetic mineral product compounds, such as kaolin, zeolite, montmorillonite, talc, pearlite, bentonite, vermiculite, diatomaceous earth, and plumbago. Moreover, composite compounds, such as magnesium stannate, zinc stannate, and zirconium stannate may be acceptable. From the viewpoint of ease of availability and an effect of imparting flame retardant properties, preferable are, for example, Sb compounds, such as antimony trioxide, antimony pentoxide, antimonic acid, and antimony oxyhalide; Sn compounds, such as stannic oxide, metastannic acid, stannous oxyhalide, stannic oxyhalide, stannous hydroxide, and tin tetrachloride; Zn compounds, such as zinc oxide; Mg compounds, such as magnesium oxide and magnesium hydroxide; and composite compounds of the metal elements (i.e., Sb, Sn, Zn, and Mg), such as magnesium stannate and zinc stannate. The Sb compounds are more preferable. These compounds may be used singly or as a mixture of two or more thereof.

It is preferable for the wadding serving as the base of the flame retardant chenille yarn to contain 42.5 to 100% by weight of the halogen-containing fiber (B). The halogen-containing fiber (B) contains halogen in the fiber in a proportion of preferably 17 to 70% by weight, and more preferably 22 to 45% by weight. When the halogen content in the fabric is lower than 17% by weight, flame retardant properties of the wadding are insufficient, which makes it difficult to maintain flame retardant properties of a fabric which is a final product. When the halogen content in the fabric exceeds 70% by weight, heat resistance of the wadding is poor, which causes deterioration in processability and reduction in flame retardant properties of a fabric which is a final product. Thus, the above-mentioned contents are not preferable. Moreover, the halogen-containing fiber (B) used as the wadding is a fiber which contains a metal compound flame retardant in a proportion of preferably 0.1 to 50% by weight, and more preferably 3 to 30% by weight. When the content of the metal compound flame retardant is lower than 0.1% by weight, flame retardant properties of the wadding are insufficient, which makes it difficult to maintain flame retardant properties of a fabric which is a final product. When the content of the metal compound flame retardant exceeds 50% by weight, physical properties, such as strength, of the wadding is poor, which causes deterioration in weaving processability. Thus, the above-mentioned contents are not preferable. From the viewpoint of imparting heat resistant properties to wadding, it is preferable that the halogen-containing fiber (B) used as wadding be a fiber containing an acrylic fiber containing a copolymer of 30 to 70% by weight of acrylonitrile, 70 to 30% by weight of halogen-containing vinyl polymer, and 0 to 10% by weight of vinyl monomer which is copolymerizable with the acrylonitrile and the halogen-containing vinyl polymer in such a manner that the total content becomes 100% by weight. The amount of the halogen-containing vinyl polymer in the acrylic fiber used as the wadding is more preferably 22 to 45% by weight. When the content of the halogen-containing vinyl polymer is smaller than 30% by weight, flame retardant properties of the wadding are insufficient, which makes it difficult to maintain flame retardant properties of a fabric which is a final product. When the halogen content in the fabric exceeds 70% by weight, heat resistance of the wadding is poor, which causes deterioration in processability and reduction in flame retardant properties of a fabric which is a final product. Thus, the above-mentioned contents are not preferable. From the viewpoint of imparting frame retardant properties and heat resistant properties to a fabric, the halogen-containing vinyl polymer is preferably a vinylidene chloride polymer or a copolymer of vinylidene chloride and acrylonitrile. The halogen-containing fiber (B) used as the wadding preferably has a decomposition starting temperature of 200 to 260° C. The decomposition starting temperatures is more preferably 210 to 250° C. The halogen-containing fiber (B) used as the wadding has a melting temperature of preferably 170 to 240° C., and more preferably 190 to 240° C.

Moreover, as the wadding of the flame retardant chenille yarn, a substance containing 42.5 to 100% by weight of the cellulose fiber (C) may be used. In this case, it is preferable for the fancy yarn serving as a napped part to contain the halogen-containing fiber (B). It is more preferable that the halogen-containing fiber (B) contain, in the fiber, 17 to 70% by weight of halogen and 0.1 to 50% by weight of metal compound flame retardant. It is more preferable that the halogen content in the halogen-containing fiber (B) be 22 to 45% by weight. When the halogen content is lower than 17% by weight, flame retardant properties of the fancy yarn are insufficient, which makes it difficult to maintain flame retardant properties of a fabric which is a final product. When the halogen content exceeds 70% by weight, heat resistance of the fancy yarn is poor, which causes reduction in volume of the napped part of the flame retardant chenille yarn, resulting in deterioration of quality of a final product. Thus, the above-mentioned contents are not preferable. It is more preferable that the amount of the metal compound flame retardant contained in the halogen-containing fiber be 3 to 25% by weight based on the weight of the fiber. When the amount of the metal compound flame retardant is lower than 0.1% by weight, flame retardant properties of the fancy yarn are insufficient, which makes it difficult to maintain flame retardant properties of a fabric which is a final product. When the amount of the metal compound flame retardant exceeds 50% by weight, processability at the time of processing a chenille yarn and the glossy feeling of the chenille yarn decrease, which causes deterioration of quality of a fabric. Thus, the above-mentioned contents are not preferable. From the viewpoint of imparting heat resistant properties to the fancy yarn, it is preferable that the halogen-containing fiber (B) contained in the fancy yarn be an acrylic fiber containing a copolymer of 30 to 70% by weight of acrylonitrile, 70 to 30% by weight of halogen-containing vinyl polymer, and 0 to 10% by weight of vinyl monomer which is copolymerizable with the acrylonitrile and the halogen-containing vinyl polymer in such a manner that the total content becomes 100% by weight. It is preferable that the amount of the halogen-containing vinyl polymer in the acrylic fiber be 22 to 45% by weight. When the amount of the halogen-containing vinyl polymer in the acrylic fiber is lower than 30% by weight, flame retardant properties of the fancy yarn are insufficient, which makes it difficult to maintain flame retardant properties of a fabric which is a final product.

When the amount of the halogen-containing vinyl polymer in the acrylic fiber exceeds 70% by weight, heat resistance of the fancy yarn is poor, which causes reduction in volume of a napped part of the chenille yarn, resulting in deterioration of quality of a final product. Thus, the above-mentioned contents are not preferable. From the viewpoint of imparting frame retardant properties and heat resistance properties to a fabric, it is preferable that the halogen-containing vinyl polymer be a vinylidene chloride polymer or a copolymer of vinylidene chloride and acrylonitrile.

In order to improve abrasion resistance when formed into fabric, a nylon fiber may be blended in the flame retardant chenille yarn. More specifically, a nylon spun yarn and a nylon filament may be blended in the flame retardant chenille yarn, and a mixed yarn obtained by mixing a nylon fiber in the flame retardant chenille yarn may be used. The nylon fiber may be blended only in the wadding part of the flame retardant chenille yarn or may be blended in both the wadding and the fancy yarn. Mentioned as the nylon fiber is a fiber containing, as a major component, a long chain synthetic polymer in which 85% by weight or more of repeated amide bonds are combined with an aliphatic or cyclo aliphatic unit, such as Nylon 6 and Nylon 66. For the prevention of fracture of the flame retardant chenille yarn, the nylon fiber is contained in the wadding part in a proportion of preferably 2.5 to 15% by weight, and more preferably 5 to 10% by weight. When the nylon fiber contained in the wadding part is lower than 2.5% by weight, an effect of improving abrasion resistance is low. When the nylon fiber contained in the wadding part exceeds 15% by weight, the cost increases.

For the wadding of the flame retardant chenille yarn, two single yarns, four single yarns, or two two-ply yarns can be used similarly as in a conventional chenille yarn, but the yarns for the flame retardant chenille yarn are not limited to the above. The wadding and the fancy yarn may be formed of the same yarn or may be formed of different yarns. Moreover, when more than one wadding are used, the wadding may be formed of different yarns. As a measure for preventing the separation of the fancy yarn, a heat sealable fiber having a polymer component with a melting point as low as 200° C. or lower is blended in the wadding part, and then the fancy yarn and the wadding may be adhered to each other by heat treatment.

The fancy yarn serving as the napped part of the flame retardant chenille yarn is preferably a yarn of 30 to 68 metric count, more preferably a yarn of 40 to 68 metric count, and still more preferably a yarn of 50 to 61 metric count. When a yarn which is thicker than the yarn of 30 metric count is used, the fancy yarn after cutting is likely to separate and the abrasion resistance in a fabric is poor, which is not preferable. When a yarn which is thinner than the yarn of 68 metric count is used, the productivity of the flame retardant chenille yarn decreases, which is not preferable.

The number of times of twisting the wadding in the flame retardant chenille yarn is preferably 700 to 900 times/m, and more preferably 750 to 850 times/m. When the number of times of twisting is smaller than 700 times/m, the fancy yarn after cutting is likely to separate and the abrasion resistance in a fabric is poor. Thus, such a number of times of twisting is not preferable. When the number of times of twisting exceeds 900 times/m, yarns are likely to get entangled due to twisting when the twisted yarn is loosened and the weaving processability decreases. Thus, such a number of times of twisting is not preferable.

With respect to the twist direction of the flame retardant chenille yarn, when the wadding is formed of a single spun yarn, the flame retardant chenille yarn is preferably further twisted in the twist direction of the spun yarn, and when the wadding is formed of a two-ply yarn, the flame retardant chenille yarn is preferably further twisted in the twist direction of the two-ply yarn for the improvement of the abrasion resistance when formed into a fabric.

In order to improve the abrasion resistance when formed into a fabric, it is preferable to use two two-ply yarns for the wadding.

It is presumed that the reason for achieving improved abrasion resistance in the aforementioned fabric resides in that the fabric is produced by strongly tightening with a tightened yarn while forming no gaps.

As a woven structure for forming the union fabric of the present invention, a plain weave, a satin weave, a twill weave, etc., are mentioned similarly as in a conventional union fabric. However, the woven structure for forming the union fabric of the present invention is not limited to the above. A weaving method for bringing the chenille yarn to the surface is preferable for producing a napped-like textile. It is preferable to form a pattern with a part where the chenille yarn is present on the front side and a part where the chenille yarn is present on rear side from the viewpoint of imparting designability. As a loom for producing the union fabric of the present invention, it is also possible to use a jacquard loom, a dobby loom, etc.

With respect to the flame retardant union fabric of the present invention, the textile weight is preferably 300 to 600 g/m$^2$, and more preferably 350 to 500 g/m$^2$. When the textile weight does not reach 300 g/m$^2$, the woven structure of the textile is coarse, and a hole is likely to open at the time of combustion, and the flame retardant properties of the fabric becomes insufficient. When the textile weight exceeds 600 g/m$^2$, the flame retardant properties become insufficient or the cost increases in the case where a non-frame retardant fiber is localized in the woven structure. Thus, such textile weights are not preferable.

In order to stabilize the shape of the fabric or to improve the abrasion resistance on the back side of the fabric, the flame retardant union fabric of the present invention may be backcoated with an acrylic resin or the like or subjected to surface treatment in order to improve the abrasion resistance, water repellence, antifouling properties, antibacterial properties, weather resistance, etc., of the fabric insofar as the texture and flame retardant properties of the fabric are not sharply deteriorated.

The reason why the flame retardant union fabric of the present invention has the outstanding flame retardant properties resides in that at the time of combustion of the fabric, halogen and the metal compound flame retardant which are mainly contained in the flame retardant chenille yarn in the fabric are gasified to generate non-flammable gas, and simultaneously the carbonization of the cellulose component contained in the fabric is promoted to form a firm carbonized skeleton. Therefore even the fabric containing the polyester fiber (A) fulfils a function of preventing the formation of a big hole. Therefore, the decomposition starting temperature of the halogen-containing fiber which emits gas containing halogen and a metal compound flame retardant at the time of combustion of the fabric is preferably 200 to 260° C., and more preferably 210 to 250° C., which is lower than 260° C. which is a melting temperature of a polyester fiber. Moreover, in order to maintain the skeleton of a flame retardant chenille yarn part, when the major component fiber of the wadding of the flame retardant chenille yarn used for the fabric is the halogen-containing fiber (B), the melting temperature of the halogen-containing fiber (B) is preferably 170 to 240° C., and more preferably 190 to 240° C., which is near 240° C. which is the softening temperature of polyester fiber.

EXAMPLES

Hereinafter, the present invention will be described in more detail with reference to Examples, but the present invention is not limited thereto. The evaluation methods of various properties will be described in advance of the description of Examples. Moreover, the preparation methods of the halogen-containing fiber (B) and the flame retardant chenille yarn will be described.

(Texture Evaluation)

Evaluation of texture was performed using a KES-G5 handy compression tester manufactured by Kato. Tech Co., Ltd. A polyurethane foam (30 cm×45 cm×7.5 cm) with a density of 22 kg/m$^3$ (Type 360S, manufactured by Toyo Tire & Rubber CO., LTD.) was covered with a fabric mentioned later, and was then horizontally placed in the tester. Measurement was performed under the conditions of a compressive load of 1000 gf/cm$^2$ and a compressive deformation rate of 10 mm/second. Compressibility was calculated according to the following formula (I) from the measurement data. Then, a sample with a high compressibility, i.e., ease of compression, was evaluated to have a good texture. More specifically, a sample with a compressibility of 15% or more was evaluated as "○", a sample with a compressibility of not less than 12% and less than 15% was evaluated as "Δ", and a sample with a compressibility of less than 12% was evaluated as "x". It should be noted that the urethane foam not covered with a fabric was measured under the same conditions, the compressibility was 30%.

$$\text{Compressibility}(\%)=(\text{Urethane foam thickness before measurement (7.5 cm)}-\text{Smallest urethane foam thickness at the time of measurement})/\text{Urethane foam thickness before measurement}\times 100 \quad (1)$$

(Flame Retardant Evaluation)

a Polyurethane Foam Having a Thickness of 7.5 cm and a Density of 22 kg/m$^3$ (Type 360S, manufactured by Toyo Tire & Rubber CO., LTD.) and covered with a fabric mentioned later was tested according to the Source 1 method of Flame retardant test BS 5852:1990 for home chairs in England. More specifically, the polyurethane foams covered with the fabric mentioned later were placed at right angles while imaging the seat and the back of a chair. Then, the contact portion was indirectly flamed for 20 seconds with a burner which supplies 45 ml/min of commercial butane, and the afterflame time was measured.

In this flame retardant evaluation, when the dimension of a hole formed due to combustion during the test was measured in the fabric warp direction, a sample having holes with a dimension of lower than 0.5 cm was evaluated as "◎" and a sample having holes with a dimension of 0.5 to 2 cm was evaluated as "○". Moreover, among samples having holes with a dimension of larger than 2 cm, the samples in which the urethane foams were not flamed were evaluated as "Δ", and among samples having holes with a dimension of larger that 2 cm, the samples in which the urethane foams were flamed were evaluated as "x".

(Abrasion Resistance Evaluation in Fabric)

A test was performed according to Load 12 kPa method of BS EN ISO 12947-2:1999. More specifically, evaluation was performed under a load of 12 kPa using a standard abrasion cloth by a Martindale type abrasion tester in the same method as in JISL1096.

In the abrasion resistance evaluation, the weight of a separated napped part (fancy yarn) of a chenille yarn in a fabric at the time of termination of 6000 times of abrasion was measured, and the number of times until two or more yarns used for the fabric were fractured was measured. Then, the overall evaluation was performed. A sample in which the napped part was separated in a proportion exceeding 50% by weight as compared with the weight of the napped part before the test was evaluated as "□", a sample in which the napped part was separated in a proportion of 30 to 50% by weight as compared with the weight of the napped part before the test was evaluated as "Δ", a sample in which the napped part was separated in a proportion of lower than 30% by weight as compared with the weight of the napped part before the test was evaluated as "○", and a sample in which the napped part was separated in a proportion of lower than 30% by weight as compared with the weight of the napped part before the test and the number of times of fracture of two or more yarns exceeded 15,000 times was evaluated as "◎".

(Measurement of Decomposition Starting Temperature)

Measurement of the decomposition starting temperature of a fiber was performed using a TG/DTA220 (connecting station SSC500H) thermal analyzer manufactured by Seiko Instrument. Inc. A fiber was finely cut for use as a measurement sample, and measurement was performed under the conditions of a measurement weight of about 2 mg, a temperature elevation rate of 10° C./min., and an atmosphere of Air of 10 ml/min. The decomposition starting temperature was decided according to JIS-K7120.

(Definition and Measurement of Melting Temperature)

When tension is applied to a fiber under a given load, and then the fiber is heated, the fiber shrinks, and then extends due to melting or decomposition. A temperature at which the extension starts was defined as a melting temperature. The melting temperature is influenced by the amount of a sample, the weight of a load, and a heating rate. Therefore, a tension of 300 mg was applied to a fiber bundle equivalent to 17 metric count, and the fiber bundle was heated at 100° C./min.

Measurement of the melting temperature of a fiber was performed using a TMA/SS150C (connecting station SSC500H) thermal analyzer manufactured by Seiko Instruments. Inc. Measurement was performed under the following conditions: the form a sample to be measured was a fiber bundle equivalent to 17 metric count, e.g., using a single yarn in the case of a spun yarn of 17 metric count, two yarns in the case of a spun yarn of 34 metric count, three yarns in the case of a spun yarn of 51 metric count; a sample length of 5 mm; a load of 300 mg; a heating rate of 100° C./min.; and an atmosphere of Air of 10 ml/min.

(Preparation of Halogen-Containing Fiber (B) <B1 to B9>)

<B1>

A halogen-containing copolymer containing 49.5% by weight of acrylonitrile, 49.5% by weight of vinyl chloride, and 1.0% by weight of sodium styrenesulfonate was dissolved in acetone in such a manner that the polymer concentration became 27% by weight to form a polymer solution. The polymer solution was used as a spinning stock solution and extruded in 30% by weight of aqueous acetone solution using a nozzle having an aperture of 0.08 mm and the number of holes of 300. Then, the resultant was washed with water, and dried. The resultant was extended 3 times at 120° C., and heated at 150° C. for 5 minutes. Then, a finishing oil for spinning was applied. A crimp was attached, and thereafter the resultant was cut into 51 mm. The measurement results of the halogen content, the decomposition starting temperature, and the melting temperature of the obtained fiber are shown in Table 1.

[Table 1]

TABLE 1

| Halogen-containing fiber (B) <B1-B9> | | | | | |
|---|---|---|---|---|---|
| | Halogen | Additive | | Decomposition | Melting |
| | content (% by weight) | Type | Addition amount (part by weight) | starting temperature (° C.) | temperature (° C.) |
| B1 | 28 | — | — | 258 | 169 |
| B2 | 27 | Antimony trioxide | 3 | 259 | 168 |
| B3 | 34 | Antimony trioxide | 3 | 220 | 203 |
| B4 | 34 | Antimony pentoxide | 3 | 233 | 206 |
| B5 | 27 | Antimony trioxide | 30 | 222 | 193 |
| B6 | 34 | Zinc stannate | 3 | 218 | 200 |
| B7 | 32 | Antimony pentoxide | 6 | 234 | 194 |
| B8 | 29 | Antimony pentoxide | 6 | 238 | 210 |
| | | Polyglycidyl methacrylate | 10 | | |
| B9 | 18*1 | Antimony trioxide*1 | 2*1 | 355 | 256 |

*1Adhesion by post processing

<B2>

To the polymer solution produced in the same manner as in <B1>, antimony trioxide was added in an amount of 3 parts by weight based on the polymer in the polymer solution to be used as a spinning stock solution, and spinning was performed in the same manner as in <B1>. The measurement results of the halogen content, the decomposition starting temperature, and the melting temperature of the obtained fiber are shown in Table 1.

<B3 to B6>

A halogen-containing copolymer containing 49.5% by weight of acrylonitrile, 49.5% by weight of vinylidene chloride, and 1.0% by weight of sodium styrenesulfonate was dissolved in acetone in such a manner that the polymer concentration became 27% by weight. To the obtained polymer solution, antimony trioxide was added in an amount of 3 parts by weight based on the polymer in the obtained polymer solution (<B3>), antimony pentoxide was added in an amount of 3 parts by weight based on the polymer in the obtained polymer solution (<B4>), antimony trioxide was added in an amount of 30 parts by weight based on the polymer in the obtained polymer solution (<B5>), and zinc stannate was added in an amount of 3 parts by weight based on the polymer in the obtained polymer solution (<B6>) to be used as spinning stock solutions. Then, spinning was performed in the same manner as in <B1>. The measurement results of the halogen content, the decomposition starting temperature, and the melting temperature of the obtained fiber are shown in Table 1.

<B7>

A halogen-containing copolymer containing 52.5% by weight of acrylonitrile, 46.5% by weight of vinylidene chloride, and 1.0% by weight of sodium styrenesulfonate was dissolved in dimethylacetamide in such a manner that polymer concentration became 27% by weight. To the obtained polymer solution, antimony pentoxide was added in an amount of 6 parts by weight based on the polymer in the obtained polymer solution to be used as a spinning stock solution. The spinning stock solution was extruded in 30% by weight of aqueous dimethylacetoamide solution using a nozzle having an aperture of 0.08 mm and the number of holes of 300. Then, the resultant was washed with water, and dried. The resultant was extended 3 times at 120° C., and heated at 150° C. for 5 minutes. Then, a finishing oil for spinning was applied. A crimp was attached, and thereafter the resultant was cut into 51 mm. The measurement results of the halogen content, the decomposition starting temperature, and the melting temperature of the obtained fiber are shown in Table 1.

<B8>

To the polymer solution obtained in the same manner as in <B7>, antimony pentoxide was added in an amount of six parts by weight based on the polymer in the obtained polymer solution and polyglycidylmethacrylate (glycidyl methacrylate/methyl methacrylate=75/25 copolymer) was added in an amount of 10 parts by weight based on the polymer in the obtained polymer solution to be used as a spinning stock solution. Spinning was performed in the same manner as in <B7>. The measurement results of the halogen content, the decomposition starting temperature, and the melting temperature of the obtained fiber are shown in Table 1.

<B9>

A polyester fiber containing 90% by weight or more of polyethylene terephthalate was subjected to post processing using a batch type dyeing machine in a 98° C. bath to which a flame-retardant water dispersion and a binder were added. Then, antimony trioxide in an amount of 2 parts by weight based on the fiber weight and decabromodiphenyl ether in an amount of 28 parts by weight based on the fiber weight were adhered. The halogen content of the obtained fiber was 18% by weight. The measurement results of the decomposition starting temperature and the melting temperature of the obtained fiber are shown in Table 1.

(Preparation of Flame Retardant Chenille Yarn (Y) <Y1 to Y18> and Non-Flame Retardant Chenille Yarn <y1 to y2>)

Flame retardant chenille yarns (Y) <Y1 to Y18> and non-flame retardant chenille yarns <y1 to y2> were produced by spinning the halogen-containing fibers (B) of B1 to B9, rayon, and Nylon 66 at proportions and of yarn counts shown in Table 2 and with the structures shown in Table 2. The halogen contents and the amounts of the metal compound flame retardant of the obtained chenille yarns are shown in Table 2. It should be noted that each of the chenille yarns used in the Examples and Comparative Examples is almost formed of a fancy yarn. The proportion of wadding in the chenille yarns are as follows: about 24% by weight in the chenille yarns Y1 to Y12 and y1 to y2; about 31% by weight in the chenille yarn Y13; about 21% by weight in the chenille yarn Y14; about 26% by weight in the chenille yarn Y15; about 20% by weight in the chenille yarns Y16 to Y17; and 22% by weight in the chenille yarn Y18.

[Table 2]

TABLE 2

Flame retardant chenille yarn (Y) <Y1 to Y18> and Non-frame retardant chenille yarn <y1 to y2>

| | Wadding | | | Fancy yarn | | |
|---|---|---|---|---|---|---|
| | Fiber | Proportion in wadding (% by weight) | Yarn count (Metric count) | Fiber | Proportion in fancy yarn (% by weight) | Yarn count (Metric count) |
| Y1 | B2 | 100 | 34 | B2 | 100 | 34 |
| Y2 | B3 | 100 | 34 | B3 | 100 | 34 |
| Y3 | B4 | 100 | 34 | B4 | 100 | 34 |
| Y4 | B6 | 100 | 34 | B6 | 100 | 34 |
| Y5 | B7 | 100 | 34 | B7 | 100 | 34 |
| Y6 | B8 | 100 | 34 | B8 | 100 | 34 |
| Y7 | B9 | 100 | 34 | B9 | 100 | 34 |
| Y8 | B5 | 100 | 34 | B1 | 100 | 34 |
| Y9 | Rayon | 100 | 34 | B3 | 100 | 34 |
| Y10 | B3 | 90 | 34 | B3 | 90 | 34 |
| | Nylon | 10 | | Nylon | 10 | |
| Y11 | B3 | 100 | 34 | B3 | 100 | 51 |
| Y12 | B3 | 100 | 34 | B3 | 100 | 51 |
| Y13 | B3 | 100 | 51 | B3 | 100 | 51 |
| Y14 | B3 | 100 | 34 | B3 | 100 | 34 |
| Y15 | B3 | 100 | 34 | B3 | 100 | 34 |
| Y16 | B2 | 100 | 34 | B2 | 100 | 41 |
| Y17 | B3 | 100 | 34 | B3 | 100 | 41 |
| Y18 | B3 | 100 | 34 | B3 | 100 | 41 |
| y1 | B1 | 100 | 34 | B1 | 100 | 34 |
| y2 | Rayon | 100 | 34 | Rayon | 100 | 34 |

| | Preparation conditions of chenille yarn | | | | | Amount of |
|---|---|---|---|---|---|---|
| | Structure of wadding | Twist direction | Number of times of twist (time/m) | Yarn count (Metric count) | Halogen content (% by weight) | metal compound flame retardant (% by weight) |
| Y1 | Two | Same directions as wadding and spun yarn | 750 | 4 | 27 | 2.9 |
| Y2 | Two | Same directions as wadding and spun yarn | 750 | 4 | 34 | 2.9 |
| Y3 | Two | Same directions as wadding and spun yarn | 750 | 4 | 34 | 2.9 |
| Y4 | Two | Same directions as wadding and spun yarn | 750 | 4 | 34 | 2.9 |
| Y5 | Two | Same directions as wadding and spun yarn | 750 | 4 | 32 | 5.7 |
| Y6 | Two | Same directions as wadding and spun yarn | 750 | 4 | 29 | 5.2 |
| Y7 | Two | Same directions as wadding and spun yarn | 750 | 4 | 18 | 2 |
| Y8 | Two | Same directions as wadding and spun yarn | 750 | 4 | 28 | 7.4 |
| Y9 | Two | Same directions as wadding and spun yarn | 750 | 4 | 26 | 2.3 |
| Y10 | Two | Same directions as wadding and spun yarn | 750 | 4 | 31 | 2.7 |
| Y11 | Two | Same directions as wadding and spun yarn | 750 | 4 | 34 | 2.9 |
| Y12 | Two | Same directions as wadding and spun yarn | 600 | 4 | 34 | 2.9 |
| Y13 | Two two-ply yarns | Same directions as wadding and two-ply yarn | 750 | 4 | 34 | 2.9 |
| Y14 | Two | Same directions as wadding and spun yarn | 750 | 3.5 | 34 | 2.9 |
| Y15 | Two | Same directions as wadding and spun yarn | 750 | 4.5 | 34 | 2.9 |
| Y16 | Two | Same directions as wadding and spun yarn | 750 | 4 | 27 | 2.9 |
| Y17 | Two | Same directions as wadding and spun yarn | 750 | 4 | 34 | 2.9 |
| Y18 | Two | Same directions as wadding and spun yarn | 750 | 4.5 | 34 | 2.9 |
| y1 | Two | Same directions as wadding and spun yarn | 750 | 4 | 28 | 0 |
| y2 | Two | Same directions as wadding and spun yarn | 750 | 4 | 0 | 0 |

Examples 1 to 9 and Comparative Examples 1 to 2

A polyester wooly 60 metric count yarn was used as a warp in such a manner as to be 59 yarns/cm in a fabric and, a flame retardant chenille yarn or a non-flame retardant chenille yarn, and rayon 12 metric count spun yarn shown in Table 3 were alternately used as a weft in such a manner as to be 14 yarns/cm in a fabric to thereby form five satin woven materials in such a manner that the chenille yarn came to the surface. Then, the side where the chenille yarn came to the surface was defined as the front side (or the evaluation side), and evaluation was performed. The results are shown in Table 3.

[Table 3]

TABLE 3

Examples 1 to 9 and Comparative Examples 1 to 2

| | | | Example 1 | Example 2 | Example 3 | Example 4 | Example 5 | Example 6 |
|---|---|---|---|---|---|---|---|---|
| Used chenille yarn | Yarn type | | Y1 | Y2 | Y3 | Y4 | Y5 | Y6 |
| | Halogen content (% by weight) | | 27 | 34 | 34 | 34 | 32 | 29 |
| | Amount of metal compound flame retardant (% by weight) | | 2.9 | 2.9 | 2.9 | 2.9 | 5.7 | 5.2 |
| Fiber amount in fabric | Amount of polyester fiber (A) (% by weight) | | 29 | 29 | 29 | 29 | 29 | 29 |
| | Amount of halogen-containing fiber (B) (% by weight) | | 53 | 53 | 53 | 53 | 53 | 53 |
| | Amount of cellulose fiber (C) (% by weight) | | 18 | 18 | 18 | 18 | 18 | 18 |
| Amount of weaving yarn forming fabric | Amount of weaving yarn containing polyester fiber as warp (% by weight) | | 29 | 29 | 29 | 29 | 29 | 29 |
| | Amount of chenille yarn as weft (% by weight) | | 53 | 53 | 53 | 53 | 53 | 53 |
| | Another weaving yarn as weft | Constituent fiber | Rayon | Rayon | Rayon | Rayon | Rayon | Rayon |
| | | Amount of yarn in fabric (% by weight) | 18 | 18 | 18 | 18 | 18 | 18 |
| Textile weight (g/m2) | | | 360 | 360 | 360 | 360 | 360 | 360 |
| Result | Texture | | ○ | ○ | ○ | ○ | ○ | ○ |
| | Flame retardant properties | | ○ | ◎ | ◎ | ◎ | ◎ | ◎ |
| | Abrasion-resistant properties | | Δ | Δ | Δ | Δ | Δ | Δ |

| | | Example 7 | Example 8 | Example 9 | Comparative Example 1 | Comparative Example 2 |
|---|---|---|---|---|---|---|
| Used chenille yarn | Yarn type | Y7 | Y8 | Y9 | y1 | y2 |
| | Halogen content (% by weight) | 18 | 28 | 26 | 28 | 0 |
| | Amount of metal compound flame retardant (% by weight) | 2.0 | 7.4 | 2.3 | 0 | 0 |
| Fiber amount in fabric | Amount of polyester fiber (A) (% by weight) | 29 | 29 | 29 | 29 | 29 |
| | Amount of halogen-containing fiber (B) (% by weight) | 53 * 2 | 53 | 40 | 53 | 0 |
| | Amount of cellulose fiber (C) (% by weight) | 18 | 18 | 31 | 18 | 71 |
| Amount of weaving yarn forming fabric | Amount of weaving yarn containing polyester fiber as warp (% by weight) | 29 | 29 | 29 | 29 | 29 |
| | Amount of chenille yarn as weft (% by weight) | 53 | 53 | 53 | 53 | 53 |

TABLE 3-continued

| Examples 1 to 9 and Comparative Examples 1 to 2 | | | | | | | |
|---|---|---|---|---|---|---|---|
| | Another weaving yarn as weft | Constituent fiber | Rayon | Rayon | Rayon | Rayon | Rayon |
| | | Amount of yarn in fabric (% by weight) | 18 | 18 | 18 | 18 | 18 |
| Textile weight (g/m2) | | | 360 | 360 | 360 | 360 | 360 |
| Result | Texture | | ○ | ○ | ○ | ○ | ○ |
| | Flame retardant properties | | Δ | ◎ | ◎ | X | X |
| | Abrasion-resistant properties | | ◎ | Δ | Δ | Δ | Δ |

*2: Halogen-containing polyester fiber

As shown in Table 3, the fabrics of Comparative Examples 1 and 2 had insufficient flame retardant properties. This is because the amount of metal compound flame retardant is insufficient in Comparative Example 1 and the amount of halogen and the amount of metal compound flame retardant are insufficient in Comparative Example 2.

Comparative Examples 3 to 5

Fabrics were produced by replacing the rayon 12 metric count spun yarn used for the weft in Examples 2, 6, and 7 by a halogen-containing fiber 12 metric count spun yarn shown in Table 4. The evaluation results of the fabrics are shown in Table 4.

[Table 4]

TABLE 4

| Comparative Examples 3 to 5 | | | Comparative Example 3 | Comparative Example 4 | Comparative Example 5 |
|---|---|---|---|---|---|
| Used chenille yarn | Yarn type | | Y2 | Y6 | Y7 |
| | Halogen content (% by weight) | | 34 | 29 | 18 |
| | Amount of metal compound flame retardant (% by weight) | | 2.9 | 5.2 | 2.0 |
| Fiber amount in fabric | Amount of polyester fiber (A) (% by weight) | | 29 | 29 | 29 |
| | Amount of halogen-containing fiber (B) (% by weight) | | 71 | 71 | 71*3 |
| | Amount of cellulose fiber (C) (% by weight) | | 0 | 0 | 0 |
| Amount of weaving yarn forming fabric | Amount of weaving yarn containing polyester fiber as warp (% by weight) | | 29 | 29 | 29 |
| | Amount of chenille yarn as weft (% by weight) | | 53 | 53 | 53 |
| | Another weaving yarn as weft | Constituent fiber | Y2 | Y6 | Y7 |
| | | Amount of yarn in fabric (% by weight) | 18 | 18 | 18 |
| Textile weight(g/m2) | | | 360 | 360 | 360 |
| Result | Texture | | ○ | ○ | ○ |
| | Flame retardant properties | | X | X | X |
| | Abrasion-resistant properties | | Δ | Δ | ◎ |

*3Halogen-containing polyester fiber

As shown in Table 4, the fabrics of Comparative Examples 3 to 5 had insufficient flame retardant properties. This is because the amount of cellulose fiber in each fabric is insufficient in these Comparative Examples.

Example 10 and Comparative Example 6

An aqueous acrylic emulsion was applied to the rear surface of the fabric produced in Example 2 in such a manner that the dry weight was 20 g/m$^2$, and the dried substance was used as Example 10. Moreover, to an aqueous acrylic emulsion solution, antimony trioxide was added in an amount of 75 parts by weight based on the solid content of the solution and decapromo diphenyl was added in an amount of 25 parts by weight based on the solid content of the solution. The mixture was applied to the rear surface of the fabric produced in Comparative Example 5 in such a manner that the dry weight was 40 g/m$^2$, and the dried substance was used as Comparative Example 6. The evaluation results are shown in Table 5. It should be noted that the numerical values of "Fiber amount in fabric" and "Amount of weaving yarn forming fabric" shown in Table 5 are numerical values relative to the total weight of fabric including the weight of a coating film of the aqueous acrylic emulsion that was applied to the rear surface of the fabric and dried.

[Table 5]

TABLE 5

Example 10, Comparative Example 6

| | | Example 10 | Comparative Example 6 |
|---|---|---|---|
| Used chenille yarn | Yarn type | Y2 | Y7 |
| | Halogen content (% by weight) | 34 | 18 |
| | Amount of metal compound flame retardant (% by weight) | 2.9 | 2.0 |
| Fiber amount in fabric | Amount of polyester fiber (A) (% by weight) | 28 | 26 |
| | Amount of halogen-containing fiber (B) (% by weight) | 51 | 48*4 |
| | Amount of cellulose fiber (C) (% by weight) | 17 | 0 |
| Amount of weaving yarn forming fabric | Amount of weaving yarn containing polyester fiber as warp (% by weight) | 28 | 26 |
| | Amount of chenille yarn as weft (% by weight) | 51 | 48 |
| | Another weaving yarn as weft: Constituent fiber | Rayon | Y7 |
| | Another weaving yarn as weft: Amount of yarn in fabric (% by weight) | 17 | 16 |
| Textile weight (g/m2) | | 380 | 400 |
| Result | Texture | Δ | X |
| | Flame retardant properties | ◎ | X |
| | Abrasion-resistant properties | Δ | ◎ |

*4Halogen-containing polyester fiber

As shown in Table 5, in Example 10, the texture slightly deteriorated, but the frame retardant properties were maintained even when a flammable component was applied to the rear surface. In contrast, in Comparative Example 6, the texture similarly deteriorated, and moreover the frame retardant properties were insufficient even when a frame retardant was added. This is because the amount of cellulose fiber in the fabric is insufficient.

Examples 11 to 12

Fabrics shown in Table 6 were produced changing the number of the wefts of Example 2. In Example 11, a frame retardant chenille yarn and a rayon 12 metric count spun yarn shown in Table 6 were alternately used for the weft in such a manner that the total number was 12 yarns/cm, and in Example 12, a frame retardant chenille yarn and a rayon 12 metric count spun yarn shown in Table 6 were alternately used for the weft in such a manner that the total number was 16 yarns/cm, thereby producing five satin fabrics. The evaluation results are shown in Table 6.

[Table 6]

TABLE 6

Examples 11 to 12

| | | Example 11 | Example 12 |
|---|---|---|---|
| Used chenille yarn | Yarn type | Y2 | Y2 |
| | Halogen content (% by weight) | 34 | 34 |
| | Amount of metal compound flame retardant (% by weight) | 2.9 | 2.9 |
| Fiber amount in fabric | Amount of polyester fiber (A) (% by weight) | 32 | 26 |
| | Amount of halogen-containing fiber (B) (% by weight) | 51 | 55 |
| | Amount of cellulose fiber (C) (% by weight) | 17 | 19 |
| Amount of weaving yarn forming fabric | Amount of weaving yarn containing polyester fiber as warp (% by weight) | 32 | 27 |
| | Amount of chenille yarn as weft (% by weight) | 51 | 55 |
| | Another weaving yarn as weft: Constituent fiber | Rayon | Rayon |
| | Another weaving yarn as weft: Amount of yarn in fabric (% by weight) | 17 | 18 |
| Textile weight(g/m2) | | 330 | 400 |
| Result | Texture | ○ | ○ |
| | Flame retardant properties | ◎ | ◎ |
| | Abrasion-resistant properties | □ | ○ |

As shown in Table 6, when the number of the wefts in the fabric is changed to change the weight of the fabric, the abrasion resistance of the fabric changes, but the flame retardant properties are not influenced.

Examples 13 to 21

The flame retardant chenille yarn of Example 2 was changed to the flame retardant chenille yarn shown in Table 7 to thereby produce fabrics. The evaluation results are shown in Table 7. It should be noted that the fabric of Example 13 contains 5% by weight of Nylon 66 contained in chenille yarn Y10 in addition to the polyester fiber (A), the halogen-containing fiber (B), and the cellulose fiber (C) shown in Table 7.

[Table 7]

TABLE 7

Examples 13 to 21

| | | Example 13 | Example 14 | Example 15 | Example 16 | Example 17 | Example 18 | Example 19 | Example 20 | Example 21 |
|---|---|---|---|---|---|---|---|---|---|---|
| Used chenille yarn | Yarn type | Y10 | Y11 | Y12 | Y13 | Y14 | Y15 | Y16 | Y17 | Y18 |
| | Halogen content (% by weight) | 31 | 34 | 34 | 34 | 34 | 34 | 27 | 34 | 34 |
| | Amount of metal compound flame | 2.7 | 2.9 | 2.9 | 2.9 | 2.9 | 2.9 | 2.9 | 2.9 | 2.9 |

TABLE 7-continued

| | | | Examples 13 to 21 | | | | | | | | |
|---|---|---|---|---|---|---|---|---|---|---|---|
| | | | Example 13 | Example 14 | Example 15 | Example 16 | Example 17 | Example 18 | Example 19 | Example 20 | Example 21 |
| | retardant (% by weight) | | | | | | | | | | |
| Fiber amount in fabric | Amount of polyester fiber (A) (% by weight) | | 29 | 29 | 29 | 29 | 27 | 31 | 29 | 29 | 31 |
| | Amount of halogen-containing fiber (B) (% by weight) | | 48 | 53 | 53 | 53 | 57 | 50 | 53 | 53 | 50 |
| | Amount of cellulose fiber (C) (% by weight) | | 18 | 18 | 18 | 18 | 16 | 19 | 18 | 18 | 19 |
| Amount of weaving yarn forming fabric | Amount of weaving yarn containing polyester fiber as warp (% by weight) | | 29 | 29 | 29 | 29 | 27 | 31 | 29 | 29 | 31 |
| | Amount of chenille yarn as weft (% by weight) | | 53 | 53 | 53 | 53 | 57 | 50 | 53 | 53 | 50 |
| | Another weaving yarn as weft | Constituent fiber | Rayon | Rayon | Rayon | Rayon | Rayon | Rayon | Rayon | Rayon | Rayon |
| | | Amount of yarn in fabric (% by weight) | 18 | 18 | 18 | 18 | 16 | 19 | 18 | 18 | 19 |
| Textile weight (g/m2) | | | 360 | 360 | 360 | 360 | 390 | 340 | 360 | 360 | 340 |
| Result | Texture | | ○ | ○ | ○ | ○ | ○ | ○ | ○ | ○ | ○ |
| | Flame retardant properties | | ◎ | ◎ | ◎ | ◎ | ◎ | ◎ | ○ | ◎ | ◎ |
| | Abrasion-resistant properties | | ◎ | ○ | □ | ◎ | ○ | Δ | ○ | ○ | ○ |

When the preparation conditions of the chenille yarn are changed as shown in Table 7, the abrasion resistance of each fabric changes, but the flame retardant properties are not influenced.

It should be noted that "Amount of weaving yarn forming fabric" in each Example shown in Tables 3 to 7 is calculated as follows.

More specifically, Example 12 is taken as an example. In Example 12, in the fabric, the polyester wooly 60 metric count yarn is used as the warp in such a manner as to be 5900 yarns/m and the flame retardant chenille yarn Y2 of 4 metric count is used in such a manner as to be 800 yarns/m and a rayon spun yarn of 12 metric count is used as the weft in such a manner as to be 800 yarns/m.

With respect to the weight per unit length of each fiber, the polyesterwooly 60 metric count yarn is 1/60 (g/m), the chenille yarn of 4 metric count is 1/4 (g/m), and the rayon spun yarn of 12 metric count is 1/12 (g/m).

Therefore, the weight per unit area of the union fabric of Example 12 is calculated as follows.

(Polyester wooly yarn: $1/60 \times 5900$ g/m$^2$)+(Chenille yarn: $1/4 \times 800$ g/m$^2$)+(Rayon spun yarn: $1/12 \times 800$ g/m$^2$)=(Polyester wooly yarn: 98 g/m$^2$)+(Chenille yarn: 200 g/m$^2$)+(Rayon spun yarn: 67 g/m$^2$)=365 g/m$^2$.

(It should be noted that "Textile weight (g/m$^2$)" indicated in each table is an actual measurement value. Since the textile shrinks due to heat or the like in a finishing process, the value is larger than the calculated value.)

Therefore, the calculative proportion of the warp and the weft forming the union fabric of Example 12 is as follows:

Polyester wooly yarn as the warp=98/365×100=27% by weight, Chenille yarn as the weft=200/365×100=55% by weight, and Rayon spun yarn as the weft=55/365×100=18% by weight.

INDUSTRIAL APPLICABILITY

The flame retardant union fabric of the present invention has self-extinguishing properties and forms a carbonized film when exposed to flame. Therefore, when the fabric is used as an upholstery for products, such as a chair using a flammable cushioning material (e.g., urethane foam) for the inside as padding, a product excellent in flame retardant properties can be obtained which is prevented from flaming to the internal padding even when a fire or the like breaks out.

The invention claimed is:

1. A flame retardant union fabric formed of a warp and a weft, the flame retardant union fabric comprising:

a polyester fiber (A);

a halogen-containing fiber (B); and a cellulose fiber (C); wherein the warp includes a weaving yarn containing polyester fiber;

the weft includes a flame retardant chenille yarn and another weaving yarn; and the flame retardant chenille yarn includes 10 to 70% by weight of halogen and 1 to 35% by weight of metal compound flame retardant.

2. The flame retardant union fabric according to claim 1, wherein the union fabric includes 6 to 60% by weight of the polyester fiber (A), 35 to 85% by weight of the halogen-containing fiber (B), and 5 to 55% by weight of the cellulose fiber (C).

3. The flame retardant union fabric according to claim 1, wherein the union fabric includes 20 to 40% by weight of the weaving yarn containing polyester fiber forming the warp, and 35 to 70% by weight of the flame retardant chenille yarn and 10 to 45% by weight of the another weaving yarn forming the weft.

4. The flame retardant union fabric according to claim 1, wherein the another weaving yarn forms the weft with the flame retardant chenille yarn and includes the cellulose fiber (C).

5. The flame retardant union fabric according to claim 1, wherein the weight of the union fabric is 300 to 600 g/m$^2$.

6. The flame retardant union fabric according to claim 1, wherein the flame retardant chenille yarn has a fancy yarn serving as a napped part, the fancy yarn being of 30 to 68 metric count.

7. The flame retardant union fabric according to claim 1, wherein the flame retardant chenille yarn has a wadding twisted at 700 to 900 times/m.

8. The flame retardant union fabric according to claim 1, wherein the wadding of the flame retardant chenille yarn is twisted, and further twisted in the same direction as a twist direction previously applied.

9. The flame retardant union fabric according to claim 1, wherein the wadding of the flame retardant chenille yarn includes two two-ply yarns and the wadding is further twisted in the same direction as twist directions of the respective two-ply yarns.

10. The flame retardant union fabric according to claim 1, wherein the flame retardant chenille yarn includes 2.5 to 15% by weight of nylon fiber in the wadding.

11. The flame retardant union fabric according to claim 1, wherein the flame retardant chenille yarn includes 42.5 to 100% by weight of the halogen-containing fiber (B) in the wadding.

12. The flame retardant union fabric according to claim 11, wherein the halogen-containing fiber (B) includes 0.1 to 50% by weight of the metal compound flame retardant.

13. The flame retardant union fabric according to claim 11, wherein the halogen-containing fiber (B) is a fiber containing a copolymer of 30 to 70% by weight of acrylonitrile, 70 to 30% by weight of halogen-containing vinyl monomer, and 0 to 10% by weight of vinyl monomer which is polymerizable with the acrylonitrile and the halogen-containing vinyl monomer in such a manner that a total weight becomes 100% by weight.

14. The flame retardant union fabric according to claim 13, wherein the halogen-containing vinyl monomer is a vinylidene chloride monomer.

15. The flame retardant union fabric according to claim 11, wherein the decomposition starting temperature of the halogen-containing fiber (B) is 200 to 260° C.

16. The flame retardant union fabric according to claim 11, wherein the melting temperature of the halogen-containing fiber (B) is 170 to 240° C.

17. The flame retardant union fabric according to claim 1, wherein the flame retardant chenille yarn includes 42.5 to 100% by weight of the cellulose fiber (C) in the wadding and includes the halogen-containing fiber (B) in the fancy yarn serving as the napped part.

18. The flame retardant union fabric according to claim 1, wherein the metal compound flame retardant is at least one selected from the group consisting of Sb compounds, Sn compounds, Zn compounds, Mg compounds, and composite compounds containing at least two metal elements selected from Sb, Sn, Zn, and Mg.

19. The flame retardant union fabric according to claim 18, wherein the metal compound flame retardant is at least one selected from the group consisting of Sb compounds, Sn compounds, Zn compounds, and composite compounds containing metal elements, Sn and Zn.

* * * * *